US007258103B2

(12) United States Patent
Tahara et al.

(10) Patent No.: US 7,258,103 B2
(45) Date of Patent: Aug. 21, 2007

(54) CONTROL APPARATUS FOR INTERNAL COMBUSTION ENGINE

(75) Inventors: Tatsuya Tahara, Toyota (JP); Kenichi Kinose, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/453,867

(22) Filed: Jun. 16, 2006

(65) Prior Publication Data

US 2007/0017483 A1 Jan. 25, 2007

(30) Foreign Application Priority Data

Jul. 25, 2005 (JP) ..... 2005-213663

(51) Int. Cl.
*F02M 51/00* (2006.01)

(52) U.S. Cl. ..... 123/431; 123/479

(58) Field of Classification Search ..... 123/431, 123/685, 686, 575, 576, 479, 690
See application file for complete search history.

(56) References Cited

U.S. PATENT DOCUMENTS 5,632,250 A * 5/1997 Kato et al. ..... 123/490
5,708,202 A 1/1998 Augustin et al.
5,711,270 A * 1/1998 Pedersen ..... 123/304
5,755,198 A * 5/1998 Grob et al. ..... 123/295
5,797,372 A * 8/1998 Sugimoto ..... 123/491

FOREIGN PATENT DOCUMENTS

| | | |
|---|---|---|
| DE | 195 21 791 A1 | 12/1996 |
| DE | 100 61 855 A1 | 8/2002 |
| DE | 10 2004 003316 A1 | 8/2004 |
| JP | A 10-089135 | 4/1998 |
| JP | A 10-176592 | 6/1998 |
| JP | A 11-082134 | 3/1999 |
| JP | A 2001-041088 | 2/2001 |
| JP | A 2003-041998 | 2/2003 |

* cited by examiner

*Primary Examiner*—Erick Solis
(74) *Attorney, Agent, or Firm*—Oliff & Berridge, PLC

(57) ABSTRACT

An engine ECU executes a program including the steps of: when the port fuel injection ratio is 100% (YES at S200), sensing the engine coolant temperature THW (S210); when the engine coolant temperature THW is higher than a threshold value (YES at S220), monitoring fuel pressure P in a high-pressure delivery pipe (S230); and when fuel pressure P rises by the received heat (YES at S240), identifying that there is no error at the high-pressure fuel system.

9 Claims, 8 Drawing Sheets

CONTROL APPARATUS FOR INTERNAL COMBUSTION ENGINE

This nonprovisional application is based on Japanese Patent Application No. 2005-213663 filed with the Japan Patent Office on Jul. 25, 2005, the entire contents of which are hereby incorporated by reference.

BACKGROUND OF THE INVENTION

1. Field of the Invention

The present invention relates to a control apparatus to identify an error occurring at a fuel system of an internal combustion engine that includes a fuel injection mechanism (in-cylinder injector) injecting fuel at high pressure into a cylinder and a fuel injection mechanism (intake manifold injector) injecting fuel towards an intake manifold or intake port. Particularly, the present invention relates to a control apparatus properly identifying an error at a high-pressure fuel system.

2. Description of the Background Art

There is known an engine including a first fuel injection valve (in-cylinder injector) for injecting fuel into the combustion chamber of a gasoline engine and a second fuel injection valve (intake manifold injector) for injecting fuel into an intake manifold or intake port, wherein the in-cylinder injector and the intake manifold injector partake in fuel injection according to the engine speed and load of the internal combustion engine. There is also known a direct injection engine including only a fuel injection valve (in-cylinder injector) to inject fuel into the combustion chamber of the gasoline engine. In a high-pressure fuel system including an in-cylinder injector, fuel having pressure increased by a high-pressure fuel pump is supplied to the in-cylinder injector via a delivery pipe, whereby the in-cylinder injector injects high-pressure fuel into the combustion chamber of each cylinder in the internal combustion engine.

Further, there is also known a diesel engine with a common rail type fuel injection system. In the common rail type fuel injection system, fuel having pressure increased by a high-pressure fuel pump is stored at the common rail. High-pressure fuel is injected into the combustion chamber of each cylinder in the diesel engine from the common rail by opening/closing an electromagnetic valve.

For the purpose of setting the fuel at high pressure in the internal combustion engine, a high-pressure fuel pump that drives a cylinder through a cam provided at a drive shaft coupled to a crankshaft of the internal combustion engine is employed.

Japanese Patent Laying-Open No. 10-176592 discloses a fuel pressure diagnostic device of a fuel injection device for an internal combustion engine that can diagnose the presence of an error in the fuel pressure at high accuracy. This fuel pressure diagnostic device includes a fuel delivery unit delivering fuel to be supplied to each cylinder of the internal combustion engine, a storage unit storing fuel delivered from the fuel delivery unit, a fuel injection mechanism provided for each cylinder to inject intermittently the fuel stored in the storage unit to the internal combustion engine, a fuel pressure sensor sensing the pressure of the fuel stored in the storage unit, a fuel control unit controlling the pressure of fuel stored in the storage unit by controlling the fuel delivery unit based on the fuel pressure sensed by the fuel pressure sensor, and a pressure abnormality diagnostic unit diagnosing whether there is an abnormality in the fuel pressure under control of the pressure control unit. The pressure abnormality diagnostic unit diagnoses whether there is an abnormality in the fuel pressure when each fuel injection mechanism is inactive.

In accordance with the fuel pressure diagnostic device disclosed in the aforementioned publication, fuel that is to be delivered to each cylinder of the internal combustion engine by the fuel delivery unit is stored in the storage unit. The fuel stored in the storage unit is injected intermittently into each cylinder by the fuel injection mechanism provided at each cylinder. The pressure of fuel stored in the storage unit is sensed by the fuel pressure sensor. Based on the sensed fuel pressure, the fuel delivery unit is controlled through the pressure control unit. The fuel pressure under control of the pressure control unit is diagnosed by the pressure abnormality diagnostic unit when each fuel injection mechanism is inactive. As a result, the presence of an error in the pressure fuel is diagnosed based on fuel pressure immune to pressure variation by the intermittent fuel injection. In an active state where each fuel injection mechanism injects fuel intermittently, the pressure of fuel stored in the storage unit will vary in a certain range. Since it is difficult to sense the pressure of fuel actually controlled, leakage of fuel caused by malfunction or the like of the fuel injection mechanism cannot be readily detected. Abnormality diagnosis of fuel pressure is conducted when the fuel injection mechanism is inactive. Therefore, a fuel pressure error can be identified based on fuel pressure that will not vary in accordance with the intermittent injection.

In the above-described internal combustion engine that includes an in-cylinder injector injecting fuel at high pressure towards a cylinder and an intake manifold injector that injects fuel towards the intake manifold or intake port, it is to be noted that the in-cylinder injector and the intake manifold injector partake in fuel injection according to the performance required of the internal combustion engine. When fuel homogeneity, for example, is required, fuel will be injected from only the intake manifold injector. Even in such a case where fuel is to be injected from only the intake manifold injector, the pressure of fuel is raised to approximately 8-13 MPa by a high-pressure pump in the high-pressure fuel system that supplies high-pressure fuel to the in-cylinder injector so that fuel (although not injected at that time from the in-cylinder injector) can be injected immediately from the in-cylinder injector in response to a subsequent instruction from the control device. This high-pressure fuel that is not injected (not consumed) will be increased in temperature by the heat received from the internal combustion engine. Accordingly, the fuel pressure is apt to increase. If detection is made of an abnormality in the high-pressure fuel system based on the aforementioned excessive increase of the fuel pressure in such a case, erroneous determination will be made even though the high-pressure fuel system per se is proper. The fuel pressure diagnostic device disclosed in Japanese Patent Laying-Open No. 10-176592 merely teaches abnormality diagnosis of fuel pressure when the fuel injection mechanism is inactive. It is not applicable to the case where an internal combustion engine including an in-cylinder injector and an intake manifold injector is operated with fuel injected from the intake manifold injector (low pressure side) and not from the in-cylinder injector (high pressure side).

SUMMARY OF THE INVENTION

In view of the foregoing, an object of the present invention is to provide a control apparatus that can properly identify an error in the fuel system in an internal combustion engine that includes at least a fuel injection mechanism having fuel supplied by a high-pressure fuel system including a high-pressure pump to inject fuel into a cylinder, and a fuel injection mechanism to inject fuel into an intake manifold or an intake port.

The control apparatus of the present invention controls an internal combustion engine that includes at least two fuel systems, and that has fuel supplied by a fuel injection mechanism connected to each fuel system. In the internal combustion engine, the fuel pressure of the first fuel system that supplies fuel to a first fuel injection mechanism is controlled so as to attain a desired level even when fuel is not injected by the first fuel injection mechanism and fuel is injected by a second fuel injection mechanism other than the first fuel injection mechanism. The control apparatus includes a sensor unit sensing the pressure of fuel at the first fuel system, a determination unit determining whether pressure of the fuel at the first fuel system has risen or not as a result of the fuel of the first fuel system receiving heat from the internal combustion engine operated with fuel injected by the second fuel injection mechanism, and an identification unit identifying that there is no error in the first fuel system when determination is made by the determination unit that the pressure of fuel at the first fuel system has risen.

Since fuel is not injected from the first fuel injection mechanism, the pressure of fuel at the first fuel system that supplies fuel to the first fuel injection mechanism is maintained at the desired level even when fuel is injected from the second fuel injection mechanism. The first fuel system receives heat from the internal combustion engine operated with the fuel injected by the second fuel injection mechanism. The first fuel system forms a closed system since fuel is not injected by the first fuel injection mechanism. The fuel at the first fuel system is increased in pressure in the closed system by receiving heat. If there is no error such as leakage at the first fuel system, determination of fuel pressure increase caused by the received heat can be made. In other words, identification can be made that there is no error when the fuel pressure at the first fuel system for the first fuel injection mechanism that does not conduct injection rises. As a result, an error in the fuel system can be identified properly in an internal combustion engine that includes at least a first fuel injection mechanism having fuel supplied from the first fuel system to inject fuel into a cylinder, and a second fuel injection mechanism having fuel supplied by the second fuel system to inject fuel into the intake manifold.

Preferably, the first fuel injection mechanism injects fuel of high pressure supplied from the first fuel system into a cylinder, and the second fuel injection mechanism injects fuel supplied from the second fuel system into an intake manifold.

In accordance with the present invention, the first fuel system injects fuel directly into the cylinder at high pressure. Therefore, the high pressure can be maintained even in the state where fuel is not injected by the first fuel injection mechanism. Identification can be made that there is no error such as leakage when the fuel pressure rises at a result of receiving heat from the internal combustion engine in such a state.

Further preferably, the first fuel injection mechanism is an in-cylinder injector, and the second fuel injection mechanism is an intake manifold injector.

In accordance with the present invention, there can be provided a control apparatus that can identify properly an error in the first fuel system in an internal combustion engine that has an in-cylinder injector qualified as the first fuel injection mechanism and an intake manifold injector qualified as the second fuel injection mechanism, provided independently, for partaking in fuel injection.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
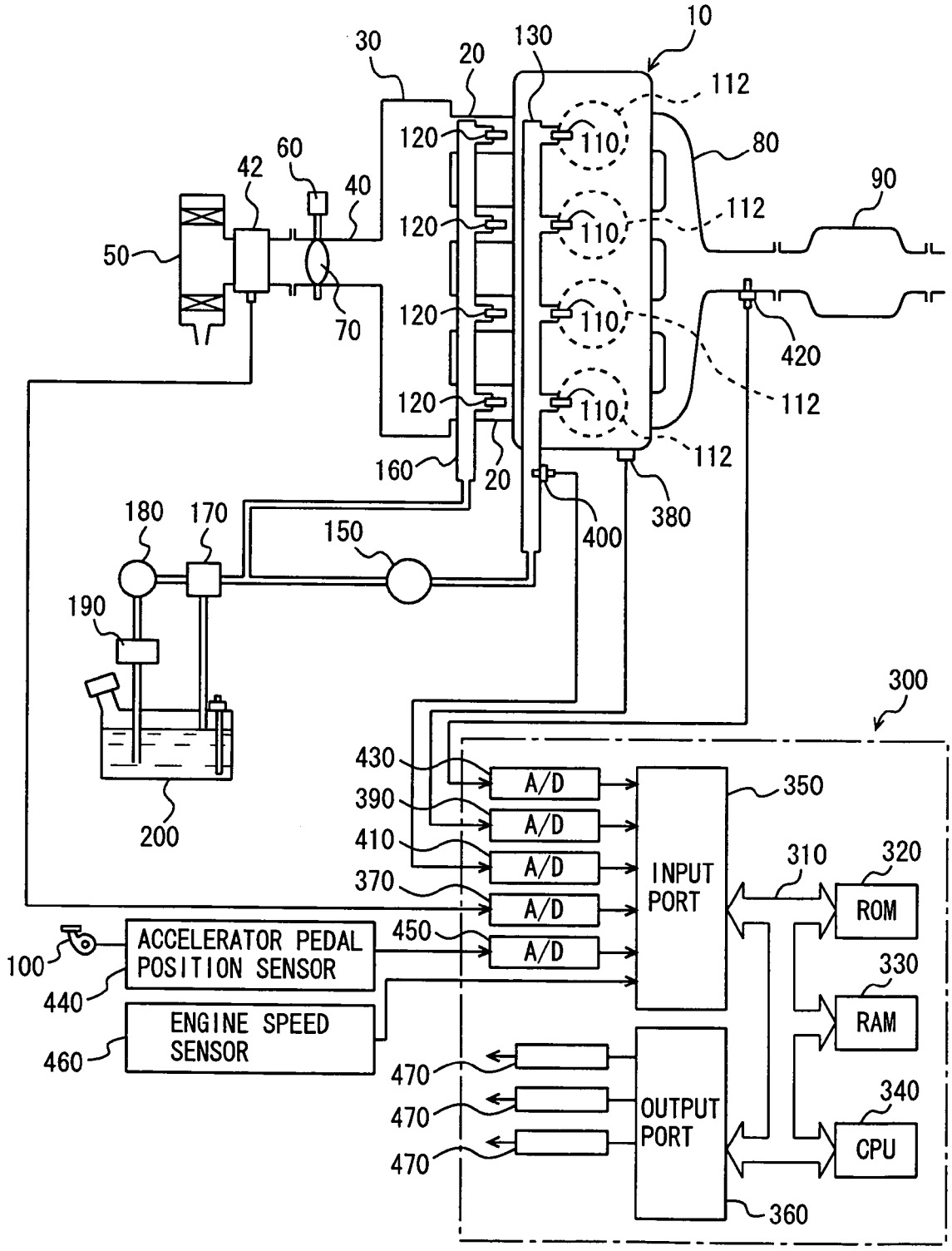
FIG. 1 is a schematic configuration diagram of an engine system under control of a control apparatus according to an embodiment of the present invention.

Embodiments of the present invention will be described hereinafter with reference to the drawings. The same elements have the same reference characters allotted. Their designation and function are also identical. Therefore, detailed description thereof will not be repeated.

FIG. 1 schematically shows a configuration of an engine system under control of an engine ECU (Electronic Control Unit) qualified as a control apparatus for an internal combustion engine according to a first embodiment of the present invention. Although an in-line 4-cylinder gasoline engine is shown in FIG. 1, application of the present invention is not limited to the engine shown, and a V-type 6-cylinder engine, a V-type 8-cylinder engine, an in-line 6-cylinder engine, and the like may be employed. The present invention is applicable as long as the engine includes at least an in-cylinder injector and an intake manifold injector for each cylinder.

Referring to FIG. 1, an engine 10 includes four cylinders 112, which are all connected to a common surge tank 30 via intake manifolds 20, each corresponding to a cylinder 112. Surge tank 30 is connected to an air cleaner 50 via an intake duct 40. An air flow meter 42 is arranged together with a throttle valve 70 driven by an electric motor 60 in intake duct 40. Throttle valve 70 has its opening controlled based on an output signal of an engine ECU 300, independent of an accelerator pedal 100. A common exhaust manifold 80 is coupled to each cylinder 112. Exhaust manifold 80 is coupled to a three-way catalytic converter 90.

There are provided for each cylinder 112 an in-cylinder injector 110 to inject fuel into a cylinder, and an intake manifold injector 120 to inject fuel towards an intake port and/or an intake manifold. Each of injectors 110 and 120 is under control based on an output signal from engine ECU 300. Each in-cylinder injector 110 is connected to a common fuel delivery pipe 130. Fuel delivery pipe 130 is connected to a high-pressure fuel pumping device 150 of an engine-drive type via a check valve that permits passage towards fuel delivery pipe 130. The present embodiment will be described based on an internal combustion engine having two injectors provided individually. It will be understood that the present invention is not limited to such an internal combustion engine. An internal combustion engine including one injector having both an in-cylinder injection function and an intake manifold injection function may be employed.

As shown in FIG. 1, high-pressure fuel pumping device 150 has its discharge side coupled to the intake side of fuel delivery pipe 130 via an electromagnetic spill valve. This electromagnetic spill valve is configured such that the amount of fuel supplied from high-pressure fuel pumping device 150 into fuel delivery pipe 130 increases as the opening of the electromagnetic spill valve is smaller, and the supply of fuel from high-pressure fuel pumping device 150 into fuel delivery pipe 130 is stopped when the electromagnetic spill valve is completely open. The electromagnetic spill valve is under control based on an output signal from engine ECU 300. The details will be described afterwards.

Each intake manifold injector 120 is connected to a common fuel delivery pipe 160 corresponding to a low pressure side. Fuel delivery pipe 160 and high-pressure fuel pumping device 150 are connected to an electric motor driven type low-pressure fuel pump 180 via a common fuel pressure regulator 170. Low-pressure fuel pump 180 is connected to a fuel tank 200 via a fuel filter 190. Fuel pressure regulator 170 is configured such that, when the pressure of the fuel discharged from low-pressure fuel pump 180 becomes higher than a preset fuel pressure, the fuel output from low-pressure fuel pump 180 is partially returned to fuel tank 200. Thus, fuel pressure regulator 170 functions to prevent the pressure of fuel supplied to intake manifold injector 120 and the pressure of fuel supplied to high-pressure fuel pumping device 150 from becoming higher than the set fuel pressure.

Engine ECU 300 is formed of a digital computer, and includes a ROM (Read Only Memory) 320, a RAM (Random Access Memory) 330, a CPU (Central Processing Unit) 340, an input port 350, and an output port 360, connected to each other via a bidirectional bus 310.

Air flow meter 42 generates an output voltage in proportion to the intake air. The output voltage of air flow meter 42 is applied to input port 350 via an A/D converter 370. A coolant temperature sensor 380 that generates an output voltage in proportion to the engine coolant temperature is attached to engine 10. The output voltage of coolant temperature sensor 380 is applied to input port 350 via an A/D converter 390.

A fuel pressure sensor 400 that generates an output voltage in proportion to the fuel pressure in fuel delivery pipe 130 is attached to fuel delivery pipe 130. The output voltage of fuel pressure sensor 400 is applied to input port 350 via an A/D converter 410. An air-fuel ratio sensor 420 that generates an output voltage in proportion to the oxygen concentration in the exhaust gas is attached to an exhaust manifold 80 upstream of three-way catalytic converter 90. The output voltage of air-fuel ratio sensor 420 is applied to input port 350 via an A/D converter 430.

Air-fuel ratio sensor 420 in the engine system of the present embodiment is a full-range air-fuel ratio sensor (linear air-fuel ratio sensor) that generates an output voltage in proportion to the air fuel ratio of the air-fuel mixture burned in engine 10. For air-fuel ratio sensor 420, an $O_2$ sensor may be used, which detects, in an ON/OFF manner, whether the air-fuel ratio of the mixture burned in engine 10 is rich or lean with respect to the stochiometric ratio.

Accelerator pedal 100 is connected to an accelerator position sensor 440 that generates an output voltage in proportion to the press-down of accelerator pedal 100. The output voltage of accelerator position sensor 440 is applied to input port 350 via an A/D converter 450. An engine speed sensor 460 generating an output pulse representing the engine speed is connected to input port 350. ROM 320 of engine ECU 300 prestores, in the form of a map, values of fuel injection quantity that are set corresponding to operation states based on the engine load factor and engine speed obtained by accelerator position sensor 440 and engine speed sensor 460 set forth above, correction values based on the engine coolant temperature, and the like.

The fuel supply mechanism of engine 10 set forth above will be described hereinafter with reference to FIG. 2. The fuel supply mechanism includes a feed pump 1100 (equivalent to low-pressure fuel pump 180 of FIG. 1) provided at fuel tank 200 to supply fuel at a low discharge level (approximately 0.3 MPa that is the pressure of the pressure regulator), a high-pressure fuel pumping device 150 (high-pressure fuel pump 1200) driven by a cam 1210, a high pressure delivery pipe 1110 (equivalent to fuel delivery pipe 130 of FIG. 1) provided to supply high-pressure fuel to in-cylinder injector 110, an in-cylinder injector 110, one provided for each cylinder, at a high-pressure delivery pipe 1110, a low-pressure delivery pipe 1120 provided to supply pressure to intake manifold injector 120, and an intake manifold injector 120, one provided for the intake manifold of each cylinder, at low-pressure delivery pipe 1120.

Feed pump 1100 of fuel tank 200 has its discharge outlet connected to low-pressure supply pipe 1400, which branches into a low-pressure delivery communication pipe 1410 and a pump supply pipe 1420. Low-pressure delivery communication pipe 1410 is connected to low-pressure delivery pipe 1120 provided at intake manifold injector 120.

Pump supply pipe 1420 is connected to the entrance of high-pressure fuel pump 1200. A pulsation damper 1220 is provided at the front of the entrance of high-pressure fuel pump 1200 to dampen the fuel pulsation.

The discharge outlet of high-pressure fuel pump 1200 is connected to a high-pressure delivery communication pipe 1500, which is connected to high-pressure delivery pipe 1100. A relief valve 1140 provided at high-pressure delivery pipe 1110 is connected to a high-pressure fuel pump return pipe 1600 via a high-pressure delivery return pipe 1610. The return opening of high-pressure fuel pump 1200 is connected to high-pressure fuel pump return pipe 1600. High-pressure fuel pump return pipe 1600 is connected to a return pipe 1630, which is connected to fuel tank 200.

Figure 2:
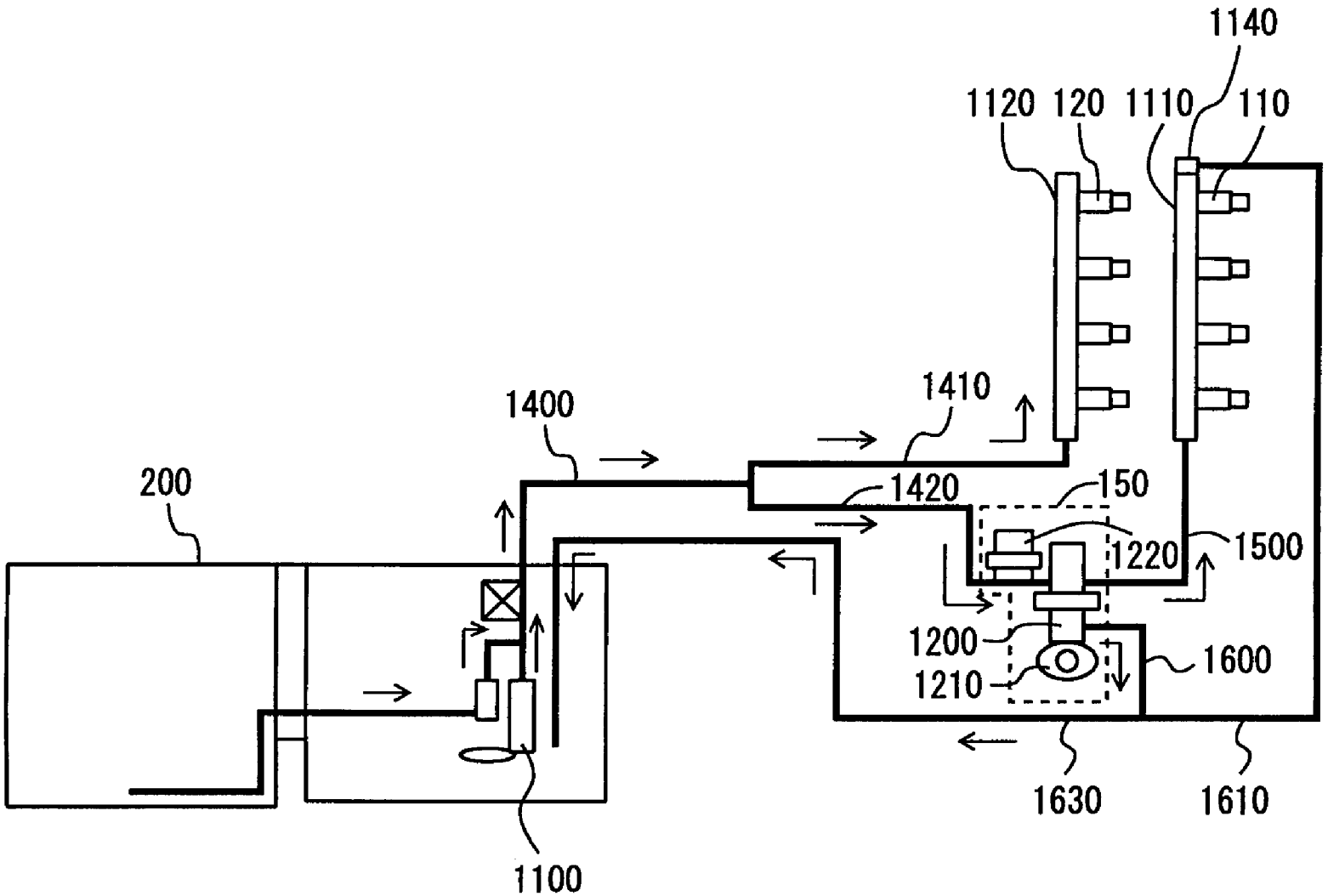
FIG. 2 shows a schematic overall view of a fuel supply mechanism of the engine system of FIG. 1.
Figure 3:
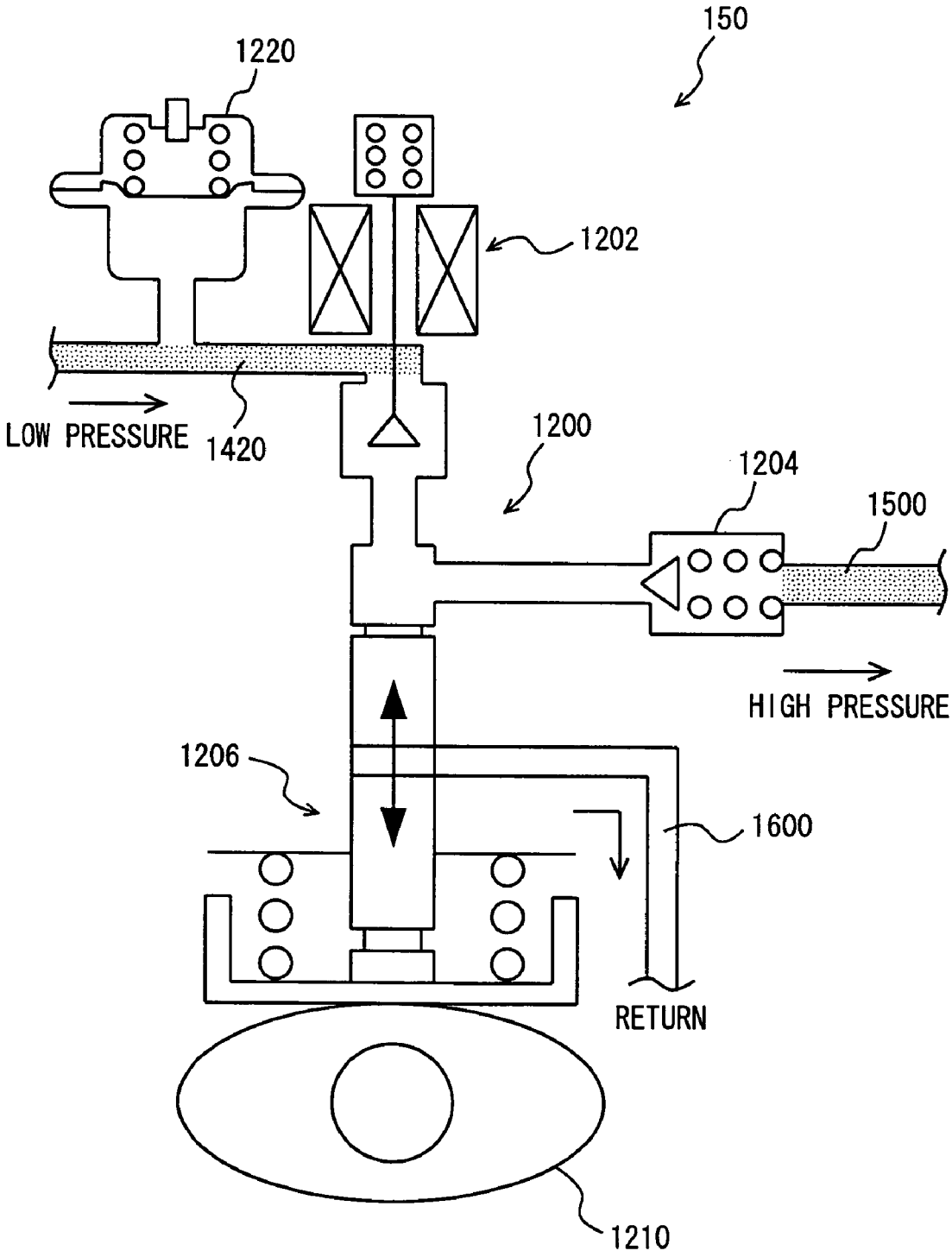
FIG. 3 is a partial enlarged view of FIG. 2.

FIG. 3 is an enlarged view of the neighborhood of high-pressure fuel pumping device 150 of FIG. 2. High-pressure fuel pumping device 150 is formed mainly of the components of high-pressure fuel pump 1200, a pump plunger 1206 driven by a cam 1210 to slide up and down, an electromagnetic spill valve 1202 and a check valve 1204 with a leak function.

When pump plunger 1206 moves downwards by cam 1210 and electromagnetic spill valve 1202 is open, fuel is introduced (drawn in). The timing of closing electromagnetic spill valve 1202 is altered when pump plunger 1206 is moving upwards by cam 1210 to control the amount of fuel discharged from high-pressure fuel pump 1200. More fuel will be discharged as the time to close electromagnetic spill valve 1202 during the pressurizing state when pump plunger 1206 is moving upwards is set earlier and less fuel will be discharged as the time to close electromagnetic spill valve 1202 is retarded.

Figure 4A:
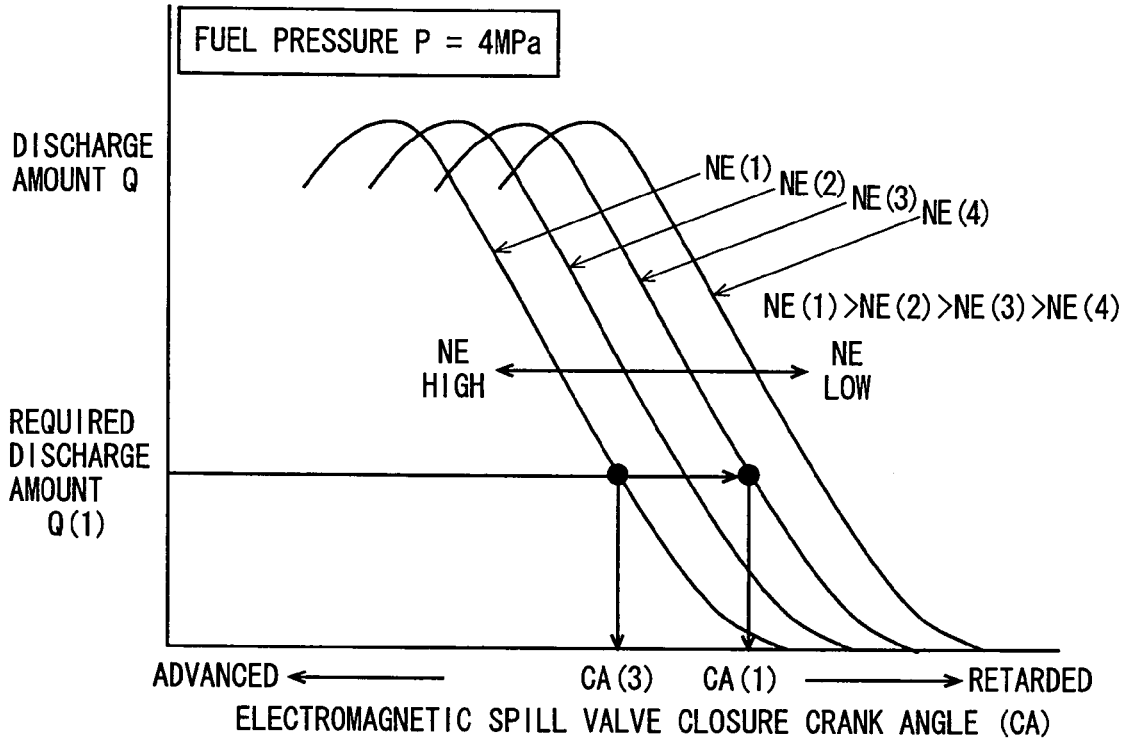
FIGS. 4A and 4B are diagrams representing characteristic curves of a high-pressure fuel pump.
Figure 4B:
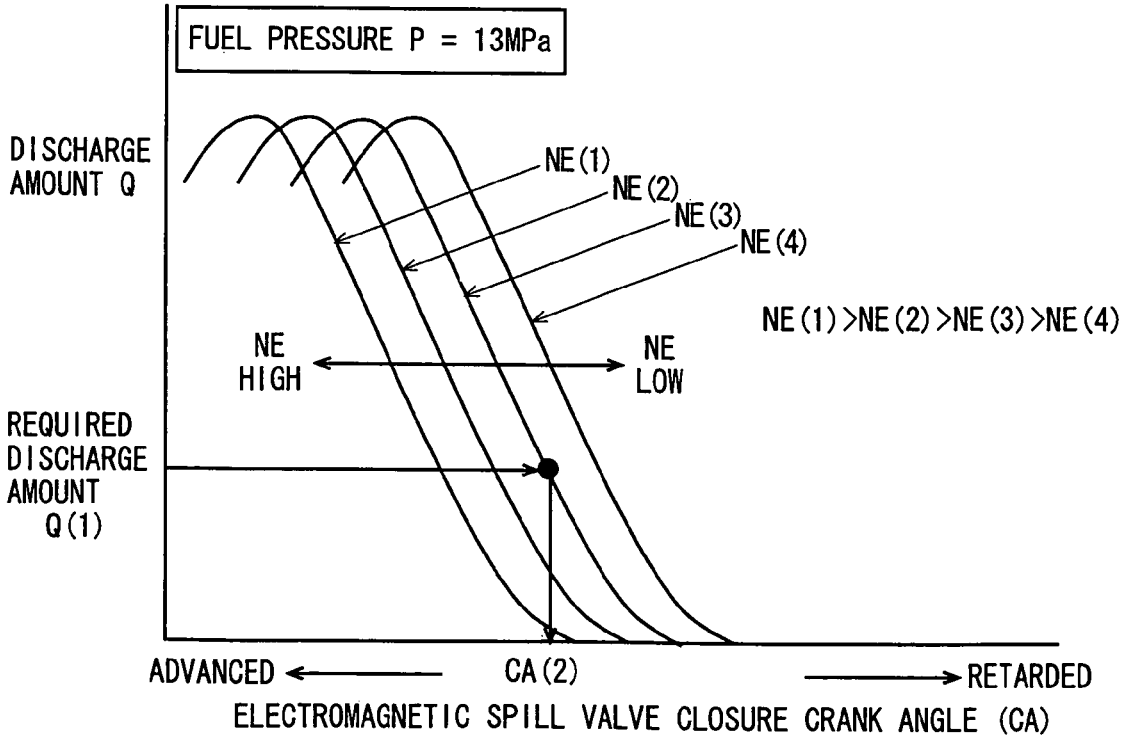

The characteristics of high-pressure fuel pump 1200 will be described hereinafter with reference to FIGS. 4A and 4B. FIG. 4A represents a pump characteristic curve indicating the relationship between a crank angle (CA) of closing electromagnetic spill valve 1202 and the discharge amount Q when the fuel pressure is 4 MPa, with speed NE of engine 10 as a parameter. FIG. 4B represents a pump characteristic curve indicating the relationship between the crank angle (CA) of closing electromagnetic spill valve 1202 and the discharge amount Q when the fuel pressure is 13 MPa, with speed NE of engine 10 as a parameter. The characteristic curves are analyzed with the values of fuel pressure P at an appropriate interval in the range of 4 MPa to 13 MPa set forth above as the parameters, in addition to the values of 4 MPa and 13 MPa.

As shown in FIGS. 4A and 4B, discharge amount Q of high-pressure fuel pump 1200 is based on the parameters of fuel pressure P and engine speed NE. When the required discharge amount Q (target discharge amount) is determined, the crank angle (CA) to close electromagnetic spill valve 1202 can be calculated, as indicated by the arrows in FIGS. 4A and 4B.

It is to be noted that, even if the required discharge amount is Q (1) and engine speed NE is NE (3), crank angle CA to close electromagnetic spill valve 1202 will vary if the fuel pressure P differs. Specifically in this case, crank angle CA to close electromagnetic spill valve 1202 is CA (1) and CA (2) when fuel pressure P is 4 MPa and 13 MPa, respectively.

Furthermore, in the case where the required discharge amount is Q (1) and fuel pressure P is 4 MPa, crank angle CA to close electromagnetic spill valve 1202 will vary if engine speed NE differs. Specifically in this case, crank angle CA is CA (1) and (CA (3) when engine speed NE is NE (3) and NE (1), respectively.

More fuel will be discharged from high-pressure fuel pump 1200 when crank angle CA to close electromagnetic spill valve 1202 is advanced, and less fuel will be discharged from high-pressure fuel pump 1200 when crank angle CA to close electromagnetic spill valve 1202 is retarded. Electromagnetic spill valve 1202 will remain at an open state if not closed. Although pump plunger 1206 moves up and down as long as cam 1210 rotates (as long as engine 10 rotates), the fuel is not pressurized since electromagnetic spill valve 1202 does not close. Therefore, discharge amount Q is 0.

The fuel under pressure will push and open check valve 1204 with a leakage function (set pressure is approximately 60 kPa) to be pumped towards high-pressure delivery pipe 1110. At this stage, the fuel pressure is feedback-controlled by fuel pressure sensor 400 provided at high-pressure delivery pipe 1110.

When crank angle CA to close electromagnetic spill valve 1202 is advanced (the period of time during which electromagnetic spill valve 1202 is closed becomes longer), the fuel discharge amount of high-pressure fuel pump 1200 is increased to raise fuel pressure P. When crank angle CA to close electromagnetic spill valve 1202 is retarded (the period of time during which electromagnetic spill valve 1202 is closed becomes shorter), the fuel discharge amount of high-pressure fuel pump 1200 is reduced to lower fuel pressure P.

Figure 5:
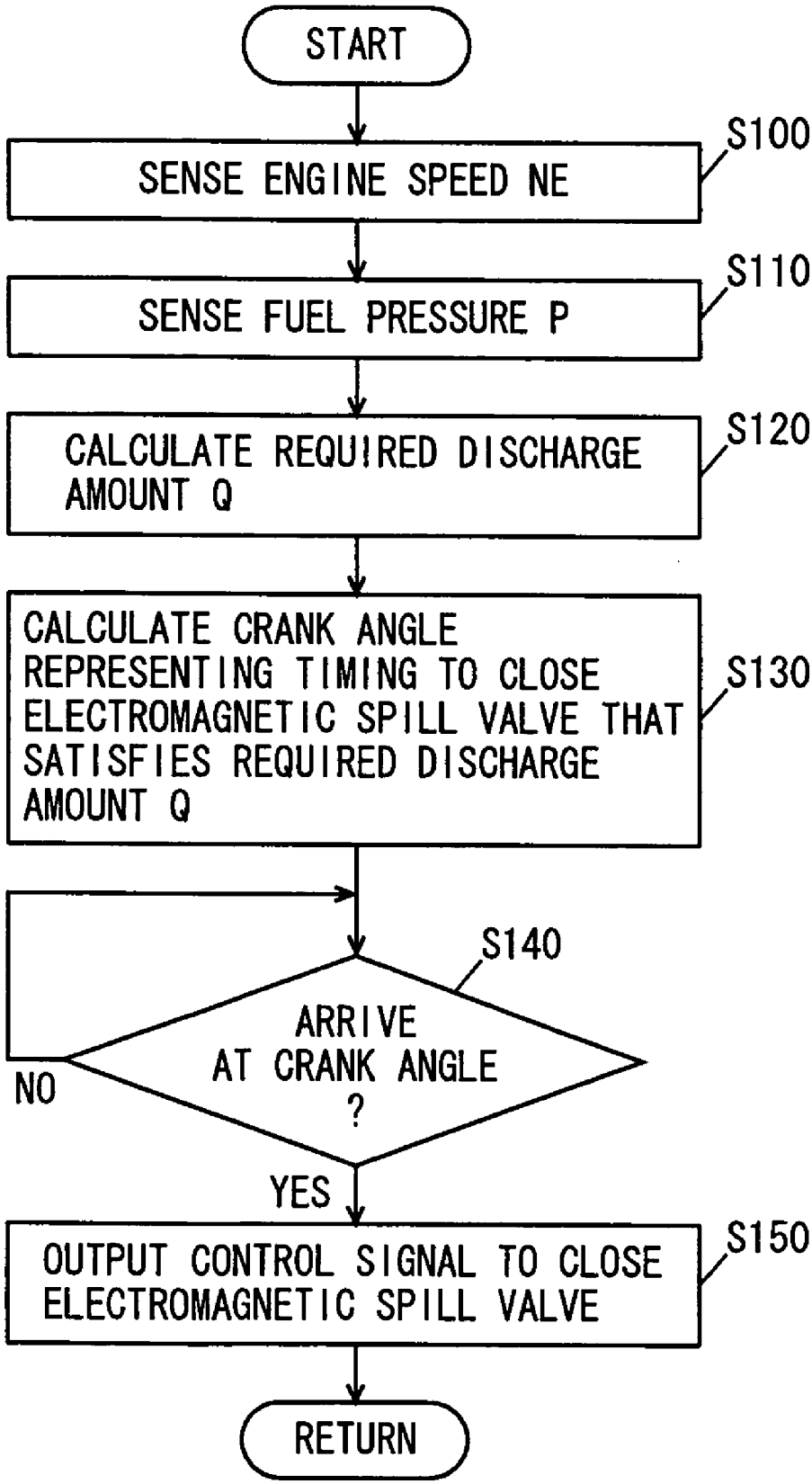
FIGS. 5 and 6 are first and second flow charts, respectively, of a control program executed by an engine ECU (Electronic Control Unit) qualified as a control apparatus according to an embodiment of the present invention.

The feedback control program of high-pressure fuel pump 1200 executed at engine ECU 300 will be described hereinafter with reference to the flow chart of FIG. 5.

At step (hereinafter, "step" abbreviated as S), engine ECU 300 detects engine speed NE. Engine ECU 300 detects engine speed NE based on a signal applied from a speed sensor 460. At S110, engine ECU 300 detects the pressure P of the high-pressure fuel. Specifically, engine ECU 300 identifies fuel pressure P based on the signal applied from fuel pressure sensor 400 provided at high-pressure delivery pipe 130.

At S120, engine ECU 300 calculates required discharge amount Q that is the discharge amount of fuel from high-pressure fuel pump 1200. The calculation procedure will be described hereinafter. High-pressure fuel pump 1200 is feedback-controlled by the P action and I action such that fuel pressure P attains the fuel pressure target value P (0).

Required discharge amount Q is represented as:

$$Q=Qp+Qi+F \tag{1}$$

where the Qp term is the proportional term in the PI feedback control, the Qi term is the integral term in PI feedback control, and the F term is the required injection amount.

Required injection amount F is calculated by:

$$F=f(\text{load, increase, DI ratio r}) \tag{2}$$

swith f as a function.

The proportional term Qp is calculated based on the actual fuel pressure P and a preset target pressure P (0) using the following equation (3):

$$Qp=K(1)\cdot(P(0)-P) \tag{3}$$

where K (1) is a coefficient, P the sensed actual fuel pressure, and P (0) is the target fuel pressure. It is appreciated from equation (3) that the proportional term Qp (>0) takes a larger value as the difference between the actual fuel pressure P and target fuel pressure P (0), when the actual fuel pressure is lower than the target fuel pressure, is larger (P(0)−P)(>0), changing towards increase in the fuel discharge amount of high-pressure fuel pump 1200. In contrast, the proportional term Qp (<0) takes a smaller value as the difference between the actual fuel pressure P and target fuel pressure P (0), when the actual fuel pressure is higher than the target fuel pressure, is smaller (P(0)−P)(<0), changing towards decrease in the fuel discharge amount of high-pressure fuel pump 1200.

The integral term Qi is calculated using equation (4) set forth below based on the previous integral term Qi, the actual fuel pressure P, preset target fuel pressure P (0), and the like.

$$Qi=Qi+K(2)\cdot(P(0)-P) \tag{4}$$

Here, K (2) is a coefficient, P is the actual pressure, and P (0) is the target value. It is appreciated from equation (4) that a value corresponding to the difference between the actual pressure and the target pressure (P(0)−P)(>0) is added to the integral term Qi at every prescribed cycle while the actual pressure P is lower than the target pressure P (0). As a result, the integral term Qi is updated gradually to a larger value, changing to the side of increasing the required discharge amount Q from high-pressure fuel pump 1200. In contrast, while the fuel pressure P is larger than the target pressure P (0), a value corresponding to the difference therebetween (P(0)−P)(<0) is subtracted from the integral term Qi at every prescribed cycle. As a result, the integral term Qi is updated gradually to a smaller value, changing to the side of reducing the required discharge amount Q from high-pressure fuel pump 1200.

At S130, engine ECU 300 calculates crank angle CA representing the timing to close electromagnetic spill valve 1202 so as to satisfy the calculated required discharge amount. At this stage, engine ECU 300 calculates crank angle CA representing the timing to close electromagnetic spill valve 1202 such that the amount of fuel discharged from high-pressure fuel pump 1200 is equal to the required discharge amount using the maps of FIGS. 4A and 4B with engine speed NE and fuel pressure P as the parameters.

At S140, engine ECU 300 determines whether the current crank angle has arrived at the level of the calculated crank angle. The current crank angle is sensed by a crank angle sensor not shown. When the current crank angle arrives at the level of the calculated crank angle (YES at S140), control proceeds to S150; otherwise (NO at S140), control returns to S140.

At S150, engine ECU 300 outputs a control signal to electromagnetic spill valve 1202 such that electromagnetic spill valve 1202 is closed.

An operation of a vehicle mounted with engine ECU 300 qualified as the control apparatus for an internal combustion engine according to the present embodiment, based on the configuration and flow chart set forth above, will be described hereinafter (particularly, the PI feedback control operation of high-pressure fuel pump 1200 of engine 10).

When high-pressure fuel pump 1200 is to be operated, engine speed NE is sensed (S100), fuel pressure P of the high-pressure fuel system is sensed (S110), and PI feedback control is conducted so as to eliminate the difference between the sensed fuel pressure P and target fuel pressure P (0). In the PI feedback control, required discharge amount Q is calculated using equations (1)-(4) set forth above.

Crank angle CA representing the timing to close electromagnetic spill valve 1202 so as to satisfy required discharged amount Q is calculated using the maps of FIGS. 4A and 4B (with engine speed NE and fuel pressure P as parameters).

Feedback control is effected such that the actual fuel pressure (control value) is equal to the target fuel pressure (target value)(i.e. there is no deviation). An alternative method can be employed. The control input in feedback control, i.e. the ratio ($\theta/\theta(\mathbf{0})$) of the cam angle $\theta$ at which electromagnetic spill valve 1202 is closed to the cam angle $\theta(\mathbf{0})$ corresponding to the delivery stroke of high-pressure fuel pump 1200, can be calculated as the duty ratio which is a control value. Using this calculated duty ratio, electromagnetic spill valve 1202 is controlled. This duty control will be described afterwards. The present invention is applicable to an engine that has crank angle CA calculated from the required discharge amount, and also to an engine controlled by the duty ratio.

With regards to the control input based on the required discharge amount Q calculated using the deviation or the like, the timing to close electromagnetic spill valve 1202 is not calculated by the duty ratio in the present embodiment. Instead, the required discharged amount Q is calculated by adding the proportional term with respect to the deviation and the integral term to the F term that is the required injection amount, and crank angle CA that represents the timing to close electromagnetic spill valve 1202 is calculated based on the required discharged amount Q such that the amount of fuel discharged from high-pressure fuel pump 1200 is equal to the required discharge amount Q. Since engine speed NE and fuel pressure P are taken as the parameters, as shown in FIGS. 4A and 4B, in the calculation of crank angle CA representing the timing to close electromagnetic spill valve 1202, control characteristics sufficiently favorable can be obtained even under the influence of the same.

An error identification program of the high-pressure fuel system including high-pressure fuel pump 1200 executed by engine ECU 300 will be described hereinafter with reference to the flow chart of FIG. 6.

At S200, engine ECU 300 determines whether the port injection ratio is 100% (DI ratio 0%) or not. This determination is made referring to a fuel injection map that will be described afterwards. When the port injection ratio is 100% (DI ratio 0%) (YES at S200), control proceeds to S210; otherwise (NO at S200), the process ends.

At S210, engine ECU 300 detects engine coolant temperature THW. At S220, engine ECU 300 determines whether engine coolant temperature THW is higher than a predetermined threshold value. This determination is made since the possibility of the high-pressure fuel system receiving heat from engine 10 operated by intake manifold injector 120 is low in the region where the coolant temperature of engine 10 is extremely low. When engine coolant temperature THW is higher than the predetermined threshold value (YES at S220), control proceeds to S230; otherwise (NO at S220), the process ends.

At S230, engine ECU 300 monitors the pressure of fuel (fuel pressure) P in high-pressure delivery pipe 1110. At S240, engine ECU 300 determines whether fuel pressure P has risen by the received heat. When fuel pressure P has risen by the received heat (YES at S240), control proceeds to S250; otherwise (NO at S240), control proceeds to S260).

At S250, engine ECU 300 identifies that there is no error at the high-pressure fuel system.

At S260, engine ECU 300 identifies that there is an error at the high-pressure fuel system. This corresponds to the case where there is leakage at the fuel delivery pipe or in-cylinder injector 110, for example.

An operation of a vehicle mounted with engine ECU 300 qualified as a control apparatus for an internal combustion engine according to the present invention, based on the configuration flow chart set forth above, will be described hereinafter (particularly, the operation of identifying an error in the high-pressure fuel system including high-pressure fuel pump 1200 of engine 10).

In engine 10 that includes an in-cylinder injector 110 and an intake manifold injector 120, engine 10 is operated based on intake manifold injector 120 injecting fuel at the fuel injection ratio of 100% (YES at S200). When engine coolant temperature THW is high at some level (YES at S220), the fuel in high-pressure delivery pipe 1110 that supplies fuel to in-cylinder injector 110 receives heat from engine 10. The temperature of fuel receiving heat is increased to a high level, whereby the pressure of fuel in high-pressure delivery pipe 1110 establishing a closed system (fuel is not injected from in-cylinder injector 110) rises in accordance with the increase in temperature. If there is an error such as leakage at the high-pressure fuel system at this stage, an increase in fuel pressure will not be detected. Therefore, by monitoring fuel pressure P corresponding to the pressure of fuel in high-pressure delivery pipe 1110 (S230) and fuel pressure P rises by the received heat (YES at S240), identification can be made that there is no error at the high-pressure fuel system (S250). In contrast, when fuel pressure P does not increase by the received heat (NO at S240), identification can be made that there is an error in the high-pressure fuel system (S260).

In accordance with the engine ECU of the present embodiment, the control characteristics in feedback control of the high-pressure fuel pump can be improved significantly, and proper identification of an error in the high-pressure fuel system can be made in an engine that has an in-cylinder injector and an intake manifold injector provided separately, partaking in fuel injection.

<Engine Under Duty Control>

The present invention is also applicable to an engine having electromagnetic spill valve 1202 controlled using a duty ratio, instead of obtaining the timing to close electromagnetic spill valve 1202 based on the required discharge amount set forth above using a crank angle. The ratio ($\theta/\theta(\mathbf{0})$) of the cam angle $\theta$ at which electromagnetic spill valve 1202 is closed to the cam angle $\theta(\mathbf{0})$ corresponding to the delivery stroke of high-pressure fuel pump 1200 is calculated as the duty ratio, qualified as a control value. This duty control will be described hereinafter. Since the engine configuration is similar to those of FIGS. 1-3, details thereof will not be repeated here.

Duty ratio DT is a controlled variable that is used for controlling the amount of the fuel discharged from high-pressure fuel pump 1200 (i.e., the timing to start closing electromagnetic spill valve 1202). Duty ratio DT changes within the range of 0% to 100%, and is related to the cam angle of cam 1210 that corresponds to the valve closing duration of electromagnetic spill valve 1202. Specifically, duty ratio DT represents the proportion of target cam angle $\theta$ with respect to the maximum cam angle $\theta(\mathbf{0})$, where "$\theta(\mathbf{0})$" is the cam angle corresponding to the maximum closing duration of electromagnetic spill valve 1202 (maximum cam angle) and "$\theta$" is the cam angle corresponding to a target value of the valve closing duration (target cam angle). Accordingly, duty ratio DT takes a value closer to 100% as the target valve closing duration of electromagnetic spill valve 1202 (the timing to start closing the valve) approximates the maximum valve closing duration. As the target valve closing duration approaches "0", duty ratio DT takes a value closer to 0%.

As duty ratio DT takes a value closer to 100%, the timing to start closing electromagnetic spill valve 1202 that is adjusted based on duty ratio DT is advanced, and the valve closing duration of electromagnetic spill valve 1202 becomes longer. As a result, the amount of the fuel discharged from high-pressure fuel pump 200 increases, resulting in a higher fuel pressure P. As duty ratio DT takes a value closer to 0%, the timing to start closing electromagnetic spill valve 1202 is retarded, and the valve closing duration of electromagnetic spill valve 1202 becomes shorter. As a result, the amount of the fuel discharged from high-pressure fuel pump 1200 decreases, resulting in a lower fuel pressure P.

The procedure of calculating duty ratio DT will be described hereinafter. Duty ratio DT is calculated based on the following equation (5):

$$DT=FF+DTp+DTi+\alpha \tag{5}$$

where FF is a feed-forward term, DTp is a proportional term, and DTi is an integral term. $\alpha$ is a correction term for taking into account the leakage of fuel from check valve 204 provided with a leakage function. In equation (5), feed-forward term FF is provided such that an amount of fuel comparable to the required fuel injection amount is supplied in advance to high-pressure delivery pipe 1110, allowing fuel pressure P to quickly approximate target fuel pressure P(0) even during the transition state of the engine. Proportional term DTp is provided for the purpose of causing fuel pressure P to approximate target fuel pressure P(0). Integral term DTi is provided for the purpose of suppressing variation in duty ratio DT attributable to fuel leakage, individual difference of high-pressure fuel pump 1200, and the like.

Engine ECU 300 controls the timing at which electric current is applied to the electromagnetic solenoid of electromagnetic spill valve 1202, that is, the timing to start closing electromagnetic spill valve 1202, based on duty ratio DT calculated by equation (5). By controlling the timing to start closing electromagnetic spill valve 1202, the valve closing duration of electromagnetic spill valve 1202 is altered to adjust the amount of fuel discharged from high-pressure fuel pump 1200. Thus, fuel pressure P varies towards target fuel pressure P(0).

Feed-forward term FF is calculated based on the engine operation state such as the final amount of fuel injection, engine speed NE and the like. Feed-forward term FF increases in proportion to a larger required fuel injection amount, and causes duty ratio DT to vary towards the 100% side, i.e., to increase the amount of fuel discharged from high-pressure fuel pump 1200.

Proportional term DTp is calculated based on the actual fuel pressure P and the preset target fuel pressure P(0), in accordance with the following equation (6):

$$DTp=K(1)\cdot(P(0)-P) \tag{6}$$

where K(1) is a coefficient, P is the actual fuel pressure, and P(0) is the target fuel pressure. It is appreciated from equation (6) that, when actual fuel pressure P is lower than target fuel pressure P(0) and the difference therebetween (P(0)−P) becomes larger, proportional term DTp takes a larger value. Thus, duty ratio DT varies towards the 100% side, i.e., to increase the amount of the fuel discharged from high-pressure fuel pump 1200. In contrast, when actual fuel pressure P is higher than target fuel pressure P(0) and the difference therebetween (P(0)−P) becomes smaller, proportional term DTp takes a smaller value. Thus, duty ratio DT varies towards the 0% side, i.e., to reduce the amount of the fuel discharged from high-pressure fuel pump 1200.

Integral term DTi is calculated based on integral term DTi obtained in the previous cycle, actual fuel pressure P and target fuel pressure P(0), using, for example, the following equation (3):

$$DTi=DTi+K(2)\cdot(P(0)-P) \tag{7}$$

where K(2) is a coefficient, P is the actual fuel pressure, and P(0) is the target fuel pressure. It is appreciated from the equation (7) that, while actual fuel pressure P is lower than target fuel pressure P(0), a value corresponding to their difference (P(0)−P) is added to integral term DTi at every prescribed cycle. As a result, integral term DTi is updated gradually to a larger value to cause duty ratio DT to vary gradually closer towards the 100% side (to increase the amount of the fuel discharged from high-pressure fuel pump 1200). In contrast, while fuel pressure P is higher than target fuel pressure P(0), the value corresponding to their difference (P(0)−P) is subtracted from integral term DTi at every prescribed cycle. As a result, integral term DTi is updated gradually to a smaller value to cause duty ratio DT to vary gradually closer towards the 0% side (to decrease the amount of the fuel discharged from high-pressure fuel pump 1200). The initial value of integral term DTi is 0.

Figure 6:
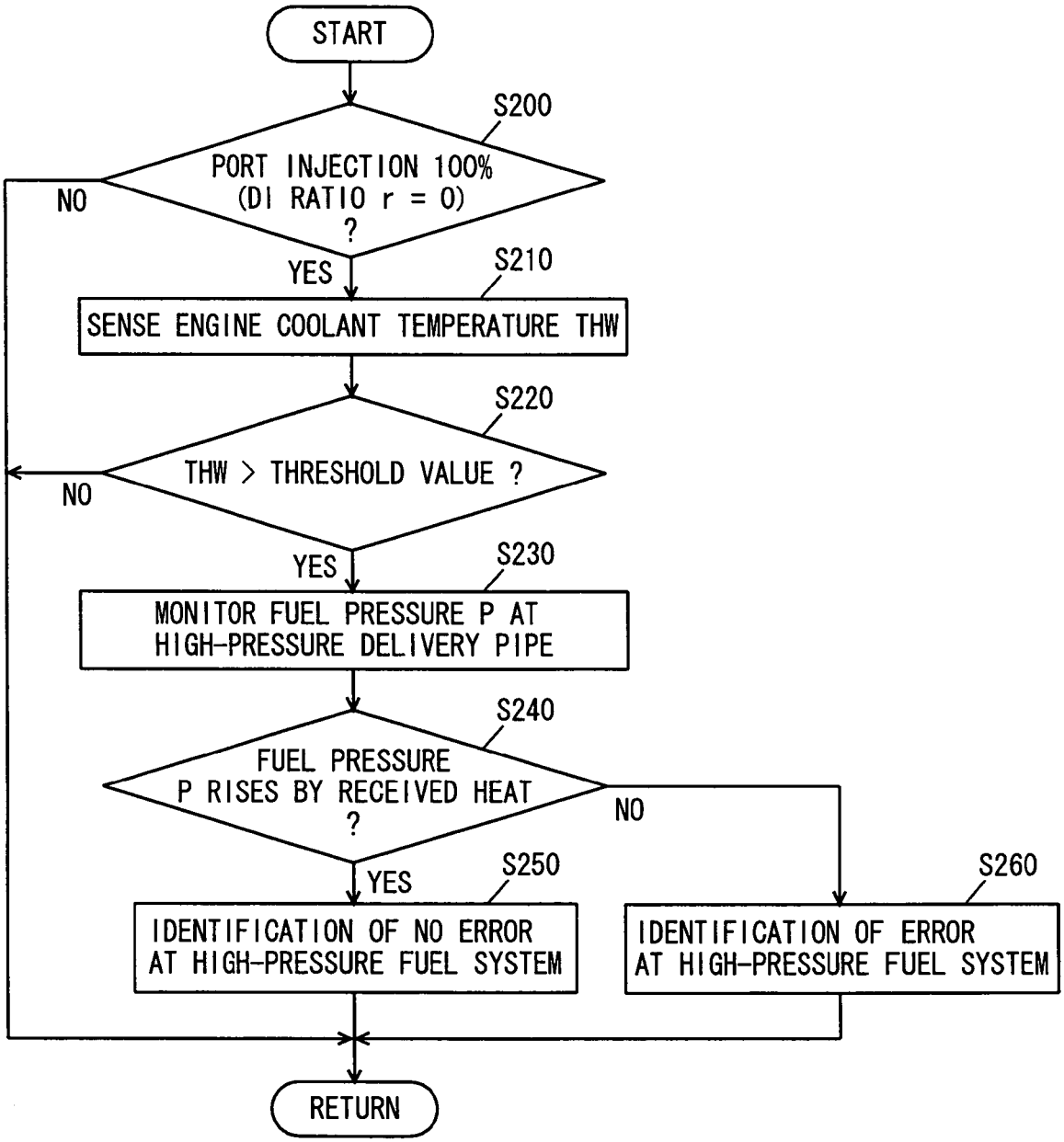

Engine 10 that is feedback-controlled by the P action and I action using the duty ratio set forth above can effect the error identification in accordance with the flow chart shown in FIG. 6.

Although the above embodiment was described in which feedback control includes a P action and an I action, the present invention is not limited thereto. The feedback may be based on feedback control including only a P action or including a D action in addition to the P action and I action.

<Engine (1) To Which Present Control Apparatus Can Be Suitably Applied >

An engine (1) to which the control apparatus of the present embodiment is suitably adapted will be described hereinafter.

Figure 7:
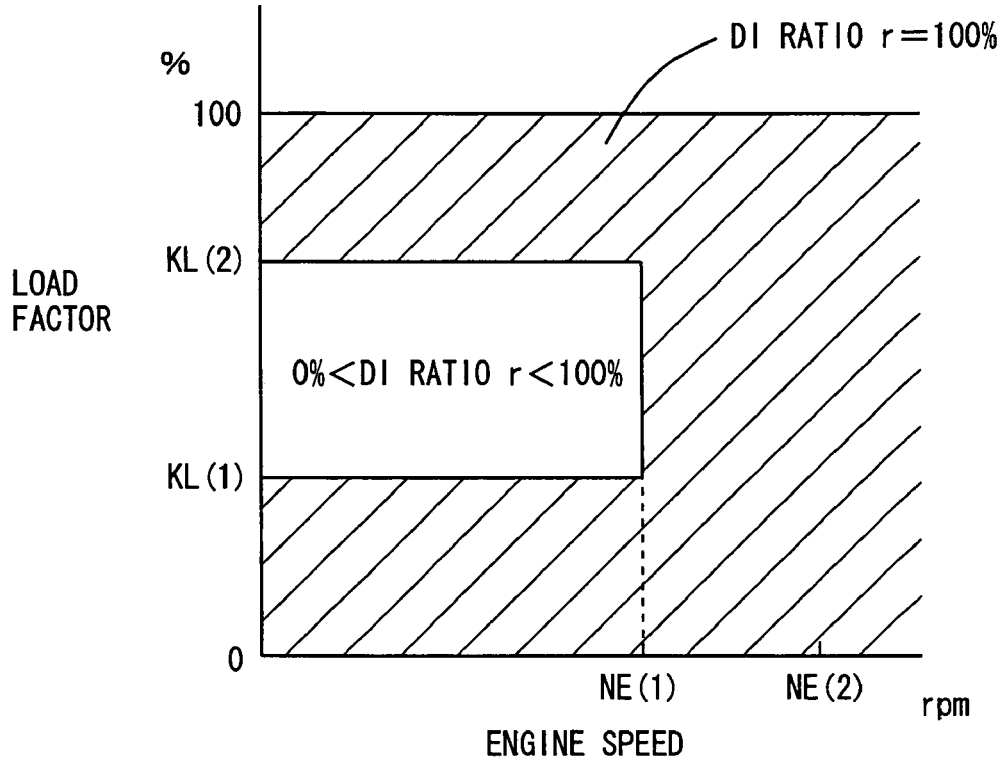
FIGS. 7 and 8 are first DI ratio maps corresponding to a warm state and a cold state, respectively, of an engine to which the control apparatus of an embodiment of the present invention is suitably adapted.
Figure 8:
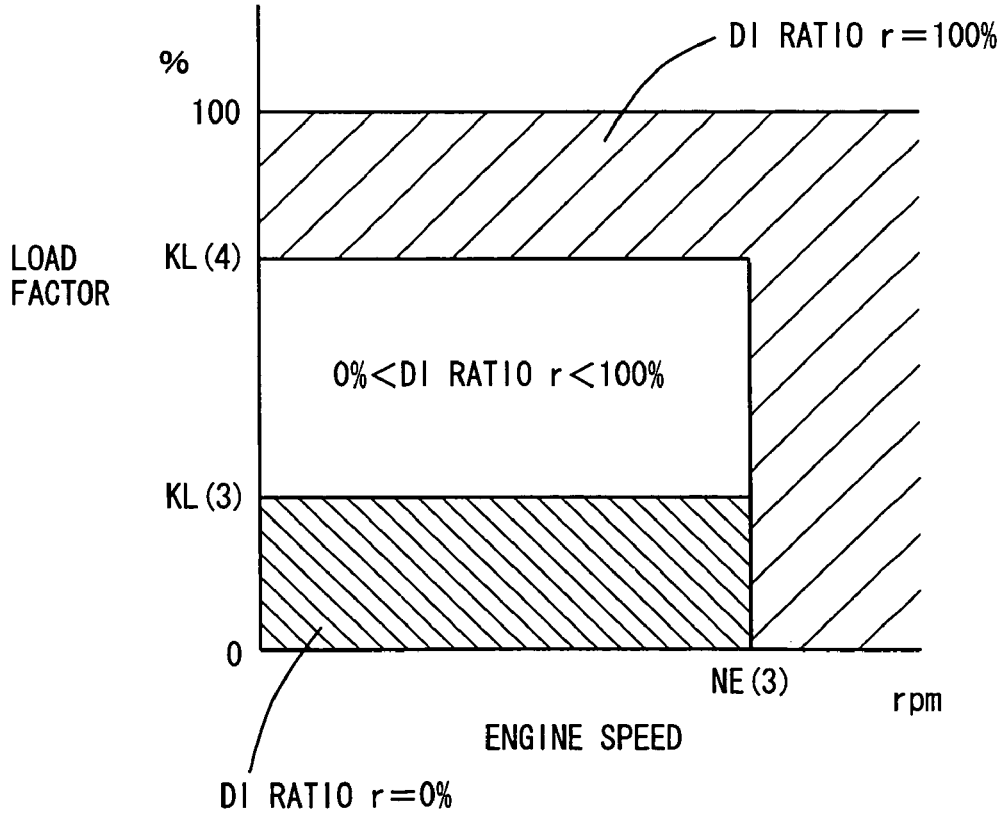

Referring to FIGS. 7 and 8, maps indicating a fuel injection ratio (hereinafter, also referred to as DI ratio (r)) between in-cylinder injector 110 and intake manifold injector 120, identified as information associated with an operation state of engine 10, will now be described. The maps are stored in ROM 320 of engine ECU 300. FIG. 7 is the map for a warm state of engine 10, and FIG. 8 is the map for a cold state of engine 10.

In the maps of FIGS. 7 and 8, the fuel injection ratio of in-cylinder injector 110 is expressed in percentage as the DI ratio r, wherein the engine speed of engine 10 is plotted along the horizontal axis and the load factor is plotted along the vertical axis.

As shown in FIGS. 7 and 8, the DI ratio r is set for each operation region that is determined by the engine speed and the load factor of engine 10. "DI RATIO r=100%" represents the region where fuel injection is carried out from in-cylinder injector 110 alone, and "DI RATIO r=0%" represents the region where fuel injection is carried out from intake manifold injector 120 alone. "DI RATIO r≠0%", "DI RATIO r≠100%" and "0%<DI RATIO r<100%" each represent the region where in-cylinder injector 110 and intake manifold injector 120 partake in fuel injection. Generally, in-cylinder injector 110 contributes to an increase of power performance, whereas intake manifold injector 120 contributes to uniformity of the air-fuel mixture. These two types of injectors having different characteristics are appropriately selected depending on the engine speed and the load factor of engine 10, so that only homogeneous combustion is conducted in the normal operation state of engine 10 (for example, a catalyst warm-up state during idling is one example of an abnormal operation state).

Further, as shown in FIGS. 7 and 8, the DI ratio r of in-cylinder injector 110 and intake manifold injector 120 is defined individually in the maps for the warm state and the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 7 is selected; otherwise, the map for the cold state shown in FIG. 8 is selected. In-cylinder injector 110 and/or intake manifold injector 120 are controlled based on the engine speed and the load factor of engine 10 in accordance with the selected map.

The engine speed and the load factor of engine 10 set in FIGS. 7 and 8 will now be described. In FIG. 7, NE(1) is set to 2500 rpm to 2700 rpm, KL(1) is set to 30% to 50%, and KL(2) is set to 60% to 90%. In FIG. 8, NE(3) is set to 2900 rpm to 3100 rpm. That is, NE(1)<NE(3). NE(2)in FIG. 7 as well as KL(3) and KL(4) in FIG. 8 are also set appropriately.

In comparison between FIG. 7 and FIG. 8, NE(3) of the map for the cold state shown in FIG. 8 is greater than NE(1) of the map for the warm state shown in FIG. 7. This shows that, as the temperature of engine 10 becomes lower, the control region of intake manifold injector 120 is expanded to include the region of higher engine speed. That is, in the case where engine 10 is cold, deposits are unlikely to accumulate in the injection hole of in-cylinder injector 110 (even if fuel is not injected from in-cylinder injector 110). Thus, the region where fuel injection is to be carried out using intake manifold injector 120 can be expanded, whereby homogeneity is improved.

In comparison between FIG. 7 and FIG. 8, "DI RATIO r=100%" in the region where the engine speed of engine 10 is NE(1) or higher in the map for the warm state, and in the region where the engine speed is NE(3) or higher in the map for the cold state. In terms of load factor, "DI RATIO r=100%" in the region where the load factor is KL(2) or greater in the map for the warm state, and in the region where the load factor is KL(4) or greater in the map for the cold state. This means that in-cylinder injector 110 alone is used in the region of a predetermined high engine speed, and in the region of a predetermined high engine load. That is, in the high speed region or the high load region, even if fuel injection is carried out through in-cylinder injector 110 alone, the engine speed and the load of engine 10 are so high and the intake air quantity so sufficient that it is readily possible to obtain a homogeneous air-fuel mixture using only in-cylinder injector 110. In this manner, the fuel injected from in-cylinder injector 110 is atomized in the combustion chamber involving latent heat of vaporization (or, absorbing heat from the combustion chamber). Thus, the temperature of the air-fuel mixture is decreased at the compression end, so that the anti-knocking performance is improved. Further, since the temperature in the combustion chamber is decreased, intake efficiency is improved, leading to high power.

In the map for the warm state in FIG. 7, fuel injection is carried out using in-cylinder injector 110 alone when the load factor is KL(1) or less. This shows that in-cylinder injector 110 alone is used in a predetermined low-load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, in which case accumulation of deposits is prevented. Further, clogging at in-cylinder injector 110 may be prevented while ensuring the minimum fuel injection quantity thereof. Thus,in-cylinder injector 110 solely is used in the relevant region.

In comparison between FIG. 7 and FIG. 8, the region of "DI RATIO r=0%" is present only in the map for the cold state of FIG. 8. This shows that fuel injection is carried out through intake manifold injector 120 alone in a predetermined low-load region (KL(3) or less) when the temperature of engine 10 is low. When engine 10 is cold and low in load and the intake air quantity is small, the fuel is less susceptible to atomization. In such a region, it is difficult to ensure favorable combustion with the fuel injection from in-cylinder injector 110. Further, particularly in the low-load and low-speed region, high power using in-cylinder injector 110 is unnecessary.

Accordingly, fuel injection is carried out through intake manifold injector 120 alone, without using in-cylinder injector 110, in the relevant region.

Further, in an operation other than the normal operation, or, in the catalyst warm-up state during idling of engine 10 (an abnormal operation state), in-cylinder injector 110 is controlled such that stratified charge combustion is effected. By causing the stratified charge combustion only during the catalyst warm-up operation, warming up of the catalyst is promoted to improve exhaust emission.

<Engine (2) to Which Present Control Apparatus is Suitably Adapted>

An engine (2) to which the control apparatus of the present embodiment is suitably adapted will be described hereinafter. In the following description of the engine (2), the configurations similar to those of the engine (1) will not be repeated.

Figure 9:
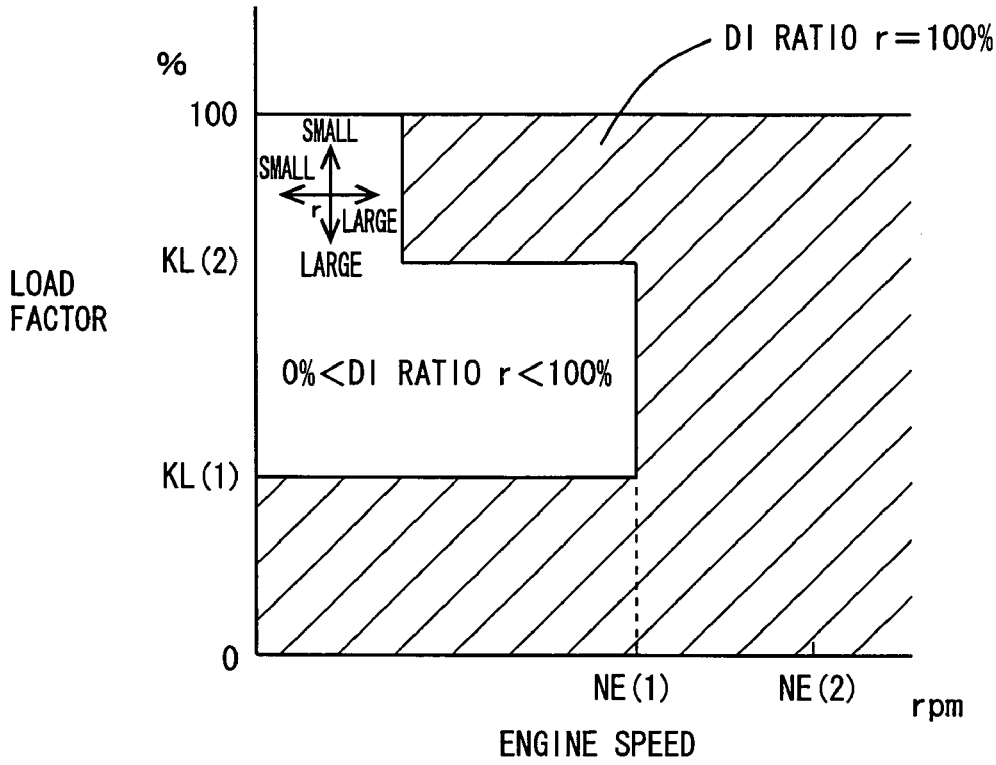
FIGS. 9 and 10 are second DI ratio maps corresponding to a warm state and a cold state, respectively, of an engine to which the control apparatus of an embodiment of the present invention is suitably adapted.
Figure 10:
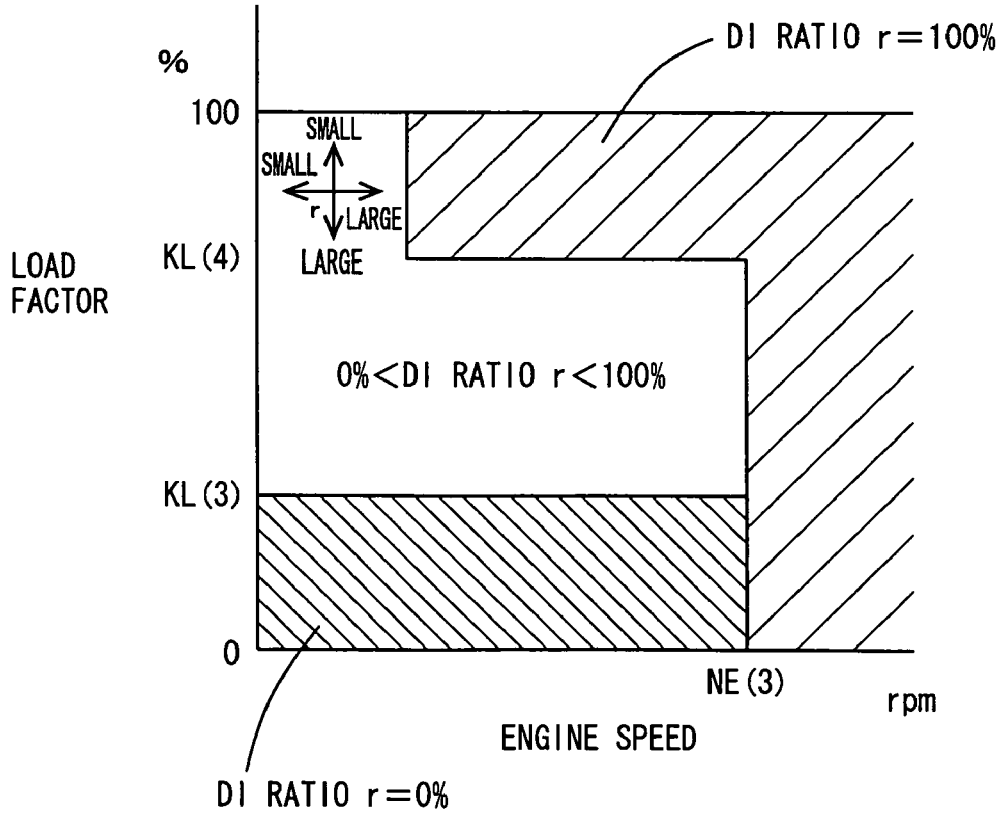

Referring to FIGS. 9 and 10, maps indicating the fuel injection ratio between in-cylinder injector 110 and intake manifold injector 120, identified as information associated with the operation state of engine 10, will be described. The maps are stored in ROM 320 of an engine ECU 300. FIG. 9 is the map for the warm state of engine 10, and FIG. 10 is the map for the cold state of engine 10.

FIGS. 9 and 10 differ from FIGS. 7 and 8 in the following points. "DI RATIO r=100%" holds in the region where the engine speed of engine 10 is equal to or higher than NE(1) in the map for the warm state, and in the region where the engine speed is NE(3) or higher in the map for the cold state. Further, "DI RATIO r=100%" holds in the region, excluding the low-speed region, where the load factor is KL(2) or greater in the map for the warm state, and in the region, excluding the low-speed region, where the load factor is KL(4) or greater in the map for the cold state. This means that fuel injection is carried out through in-cylinder injector 110 alone in the region where the engine speed is at a predetermined high level, and that fuel injection is often carried out through in-cylinder injector 110 alone in the region where the engine load is at a predetermined high level. However, in the low-speed and high-load region, mixing of an air-fuel mixture produced by the fuel injected from in-cylinder injector 110 is poor, and such inhomogeneous air-fuel mixture within the combustion chamber may lead to unstable combustion. Thus, the fuel injection ratio of in-cylinder injector 110 is to be increased as the engine speed increases where such a problem is unlikely to occur, whereas the fuel injection ratio of in-cylinder injector 110 is to be decreased as the engine load increases where such a problem is likely to occur. These changes in the DI ratio r are shown by crisscross arrows in FIGS. 9 and 10. In this manner, variation in output torque of the engine attributable to the unstable combustion can be suppressed. It is noted that these measures are substantially equivalent to the measures to decrease the fuel injection ratio of in-cylinder injector 110 in connection with the state of the engine moving towards the predetermined low speed region, or to increase the fuel injection ratio of in-cylinder injector 110 in connection with the engine state moving towards the predetermined low load region. Further, in a region other than the region set forth above (indicated by the crisscross arrows in FIGS. 9 and 10) and where fuel injection is carried out using only in-cylinder injector 110 (on the high speed side and on the low load side), the air-fuel mixture can be readily set homogeneous even when the fuel injection is carried out using only in-cylinder injector 110. In this case, the fuel injected from in-cylinder injector 110 is atomized in the combustion chamber involving latent heat of vaporization (by absorbing heat from the combustion chamber). Accordingly, the temperature of the air-fuel mixture is decreased at the compression end, whereby the antiknock performance is improved. Further, with the decreased temperature of the combustion chamber, intake efficiency is improved, leading to high power output.

In engine 10 described in conjunction with FIGS. 7-10, homogeneous combustion is realized by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in totality is ignited in the combustion chamber to realize the stratified charge combustion. Even if the fuel injection timing of in-cylinder injector 110 is set in the intake stroke, stratified charge combustion can be realized if a rich air-fuel mixture can be located locally around the spark plug.

As used herein, the stratified charge combustion includes both the stratified charge combustion and semi-stratified charge combustion set forth below. In the semi-stratified charge combustion, intake manifold injector 120 injects fuel in the intake stroke to generate a lean and homogeneous air-fuel mixture in totality in the combustion chamber, and then in-cylinder injector 110 injects fuel in the compression stroke to generate a rich air-fuel mixture around the spark plug, so as to improve the combustion state. Such a semi-stratified charge combustion is preferable in the catalyst warm-up operation for the following reasons. In the catalyst warm-up operation, it is necessary to considerably retard the ignition timing and maintain a favorable combustion state (idle state) so as to cause a high-temperature combustion gas to arrive at the catalyst. Further, a certain quantity of fuel must be supplied. If the stratified charge combustion is employed to satisfy these requirements, the quantity of fuel will be insufficient. With the homogeneous combustion, the retarded amount for the purpose of maintaining favorable combustion is small as compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine described in conjunction with FIGS. 7-10, the fuel injection timing by in-cylinder injector 110 is preferably set in the compression stroke for the reason set forth below. It is to be noted that, for most of the fundamental region (here, the fundamental region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state), the fuel injection timing of in-cylinder injector 110 is set at the intake stroke. The fuel injection timing of in-cylinder injector 110, however, may be set temporarily in the compression stroke for the purpose of stabilizing combustion, as will be described hereinafter.

When the fuel injection timing of in-cylinder injector 110 is set in the compression stroke, the air-fuel mixture is cooled by the fuel injection during the period where the temperature in the cylinder is relatively high. This improves the cooling effect and, hence, the antiknock performance. Further, when the fuel injection timing of in-cylinder injector 110 is set in the compression stroke, the time required starting from fuel injection up to the ignition is short, so that the air current can be enhanced by the atomization, leading to an increase of the combustion rate. With the improvement of antiknock performance and the increase of combustion rate, variation in combustion can be obviated to allow improvement in combustion stability.

Further, the warm map shown in FIG. 7 or 9 may be employed when in an off-idle mode (when the idle switch is off, when the accelerator pedal is pressed down), independent of the engine temperature (that is, independent of a warm state and a cold state). In other words, in-cylinder injector 110 is used in the low load region independent of the cold state and warm state.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine including at least two fuel systems, and having fuel supplied by a fuel injection mechanism connected to each of said fuel systems, controlled such that pressure of fuel at a first fuel system supplying fuel to a first fuel injection mechanism attains a desired pressure level even when fuel is not injected by said first fuel injection mechanism and fuel is injected by a second fuel injection mechanism other than said first fuel injection mechanism, said control apparatus comprising:

a sensor unit sensing pressure of fuel at said first fuel system, a determination unit determining whether pressure of fuel at said first fuel system has risen or not as a result of the fuel at said first fuel system receiving heat from said internal combustion engine operated with fuel injected by said second fuel injection mechanism, and an identification unit identifying that there is no error at said first fuel system when determination is made by said determination unit that the pressure of fuel at said first fuel system has risen.

2. The control apparatus for an internal combustion engine according to claim 1, wherein said first fuel injection mechanism is an in-cylinder injector, and said second fuel injection mechanism is an intake manifold injector.

3. The control apparatus for an internal combustion engine according to claim 1, wherein said first fuel injection mechanism includes a mechanism of injecting fuel of high pressure supplied from the first fuel system into a cylinder, and said second fuel injection mechanism includes a mechanism of injecting fuel supplied from said second fuel system into an intake manifold.

4. The control apparatus for an internal combustion engine according to claim 3, wherein said first fuel injection mechanism is an in-cylinder injector, and said second fuel injection mechanism is an intake manifold injector.

5. A control apparatus for an internal combustion engine including at least two fuel systems, and having fuel supplied by a fuel injection mechanism connected to each of said fuel systems, controlled such that pressure of fuel at a first fuel system supplying fuel to a first fuel injection mechanism attains a desired pressure level even when fuel is not injected by said first fuel injection mechanism and fuel is injected by a second fuel injection mechanism other than said first fuel injection mechanism, said control apparatus comprising:

sensor means for sensing pressure of fuel at said first fuel system, determination means for determining whether pressure of fuel at said first fuel system has risen or not as a result of the fuel at said first fuel system receiving heat from said internal combustion engine operated with fuel injected by said second fuel injection mechanism, and identification means for identifying that there is no error at said first fuel system when determination is made by said determination means that the pressure of a fuel at said first fuel system has risen.

6. The control apparatus for an internal combustion engine according to claim 5, wherein said first fuel injection mechanism is an in-cylinder injector, and said second fuel injection mechanism is an intake manifold injector.

7. The control apparatus for an internal combustion engine according to claim 5, wherein said first fuel injection mechanism includes a mechanism of injecting fuel of high pressure supplied from the first fuel system into a cylinder, and said second fuel injection mechanism includes a mechanism of injecting fuel supplied from said second fuel system into an intake manifold.

8. The control apparatus for an internal combustion engine according to claim 7, wherein said first fuel injection mechanism is an in-cylinder injector, and said second fuel injection mechanism is an intake manifold injector.

9. A control apparatus for an internal combustion engine including at least two fuel systems, and having fuel supplied by a fuel injection mechanism connected to each of said fuel systems, controlled such that pressure of fuel at a first fuel system supplying fuel to a first fuel injection mechanism attains a desired pressure level even when fuel is not injected by said first fuel injection mechanism and fuel is injected by a second fuel injection mechanism other than said first fuel injection mechanism, said control apparatus comprising an electronic control unit (ECU), wherein said electronic control unit is configured to sense pressure of fuel at said first fuel system, determine whether pressure of fuel at said first fuel system has risen or not as a result of the fuel of said first fuel system receiving heat from said internal combustion engine operated with fuel injected by said second fuel injection mechanism, and identify that there is no error at said first fuel system when determination is made that the pressure of fuel at said first fuel system has risen.

* * * * *